United States Patent [19]

Woodard

[11] Patent Number: 4,931,105

[45] Date of Patent: Jun. 5, 1990

[54] PROCESS FOR HEAT TREATING BERYLLIUM COPPER

[75] Inventor: Dudley H. Woodard, Willoughby, Ohio

[73] Assignee: Beryllium Copper Processes L.P., Beachwood, Ohio

[21] Appl. No.: 310,987

[22] Filed: Feb. 16, 1989

[51] Int. Cl.[5] ..... C22F 1/08

[52] U.S. Cl. ..... 148/2; 148/11.5 C; 148/20.6; 420/494

[58] Field of Search ..... 148/2, 11.5 C, 20.6; 420/494

[56] References Cited

U.S. PATENT DOCUMENTS

| | | | |
|---|---|---|---|
| 4,110,132 | 8/1978 | Parikh et al. | 148/11.5 C |
| 4,369,074 | 1/1983 | Bodyako et al. | 148/11.5 C |
| 4,394,185 | 7/1983 | McClelland et al. | 148/11.5 C |
| 4,533,412 | 8/1985 | Rotem | 148/11.5 C |
| 4,541,875 | 9/1985 | Woodward et al. | 148/11.5 C |
| 4,594,116 | 6/1986 | Inagaki | 148/12.7 C |
| 4,599,120 | 7/1986 | Church et al. | 420/494 |
| 4,692,192 | 9/1987 | Ikushima et al. | 148/12.7 C |
| 4,792,365 | 12/1988 | Matswi et al. | 148/12.7 C |
| 4,832,756 | 5/1989 | Woodward et al. | 148/12.7 C |

FOREIGN PATENT DOCUMENTS

| | | | |
|---|---|---|---|
| 0029047 | 8/1974 | Japan | 148/11.5 C |
| 0222565 | 12/1984 | Japan | 148/11.5 C |

OTHER PUBLICATIONS

Thomas Z. Metallkde, 52 (1961) p. 759.
Thomas et al, Z. Metallkde, 50 (1959) 466.

*Primary Examiner*—Upendra Roy

*Attorney, Agent, or Firm*—Sughrue, Mion, Zinn, Macpeak & Seas

[57] ABSTRACT

This invention provides a method for production of reproducible heat treated parts with improved mechanical properties. More specifically, the invention provides a process which comprises the steps of preparing, for example, a copper beryllium alloy melt, casting the alloy melt by a continuous process which uses rapid solidification process techniques or hot working a cast alloy and solution annealing the hot worked alloy, passing the alloy through one or more cold-working steps, applying mechanical and thermal treatments to decrease the residual lattice strains created by cold working the alloy, and then subjecting the alloy to a heat treatment, at temperatures ranging between 250° F. and 800° F., in a heat treating media that gives a rate of heat flow from the interface into the alloy that is fast enough to create those (α) precipitation mechanisms that result in increases in elongations and decreases in proportional limits, thereby attaining and maintaining the heat treating temperature before appreciable precipitation hardening takes place after quenching.

From these primary products, formed parts can be age hardened in a reproducible manner in those heat transfer media which create minimal distortion and improved mechanical properties over a broad range of temperatures. The process also provides for a more even patterned distribution of precipitates in the matrix of the alloy, both prior to and after a thermal aging process. The implementation of this process results in an alloy which exhibits an increased elongation in tandem with an increased yield stress.

24 Claims, 4 Drawing Sheets

PROCESS FOR HEAT TREATING BERYLLIUM COPPER

FIELD OF THE INVENTION

This invention provides a process for production of reproducible heat treated parts with improved mechanical properties that are formed from, for example, beryllium copper alloys. More specifically, the invention provides a process for the production, through the use of the proper heat transfer media, of mill hardened beryllium copper strip, wire, rod or tubing with improved mechanical properties. From these primary products, formed parts can be age hardened in a reproducible manner in those heat transfer media which create minimal distortion and improved mechanical properties over a broad range of temperatures.

BACKGROUND OF THE INVENTION

In beryllium copper alloys, the resultant combination of properties of strength, ductility and conductivity are controlled by the amount, size and distribution of the precipitates and residual stresses. Therefore, the sequence and degree of work hardening and thermal aging which determine the kinetics of precipitation greatly influence the ultimate properties.

Various methods are known for improving the mechanical properties and for decreasing the distortion which results during the precipitation hardening of formed parts produced from beryllium copper alloys. Unfortunately, these known methods are only partially effective and often fail to reproducibly improve the strength, fatigue life and high temperature properties of aged parts to a commercially acceptable degree.

Basically, all presently available methods for producing precipitation hardened formed parts from beryllium copper alloys include the general combination of the following sequence of processing events: preparing a beryllium copper melt: casting the melt: hot working the cast alloy; solution annealing the alloy; cold working the solution annealed alloy with optionally further mill hardening: forming parts form the cold worked alloy; and aging the cold worked beryllium copper. Various modifications have been developed in an attempt to minimize the variations in the non-reproducible dimensional and mechanical property changes experienced in this processing sequence. The product of the general combination above or any of the modifications thereto will be referred to herein as a processed beryllium copper alloy.

In this connection, reference is made to the methods disclosed in U.S. Pat. No. 4,792,365 (Matsui), U.S. Pat. No. 4,705,095 (Gasper), U.S. Pat. No. 4,692,192 (Ikushima), U.S. Pat. No. 4,657,601 (Guha), U.S. Pat. No. 4,594,116 (Inagaki), U.S. Pat. No. 4,579,603 (Woodard), U.S. Pat. No. 4,541,875 (Woodard), U.S. Pat. No. 4,533,412 (Rotem), U.S. Pat. No. 4,425,168 (Goldstein), U.S. Pat. No. 4,394,185 (McClelland), U.S. Pat. No. 4,221,257 (Narasimhan), U.S. Pat. No. 3,658,601 (Britton), U.S. Pat. No. 3,138,493 (Smith), the article entitled "Local Atomic Arrangements in Age-Hardenable Alloys" authored by J. B. Cohen, Scripta Metallurgica. Vol. 22, 1988. page 933, the article entitled "Small Angle Scattering Experiments from A1-4 wt % Cu Single Crystals Containing G.P.I. Zones", authored by V. Gerold and E. Bubeck, Scripta Metallurgica. Vol. 22, 1988, page 953, the article entitled "Stress Relaxation in Bending of Copper Beryllium Alloy Strip", authored by A. Fox in *Journal of Testing and Evaluation*. Vol. 8, No. 3, May 1980, the article entitled "High Resolution Electron Microscope Observations on G.P. Zones in an Aged Cu-1.97 wt % Be Crystal", authored by V. A. Phillips and L. E. Tanner in Acta Metallurgica, Vol. 21, April 1973. The methods disclosed in these prior art sources are only partially successful in reproducibly improving the mechanical properties and minimizing the distortions in precipitation hardened finished products.

Gerold and Bubeck studied the nucleation of G.P. zones in a single crystal containing A1-4 wt % Cu. When the oriented single crystal had been compressed during the first part of its aging, they found a difference in the nucleation rates of the G.P. zones created under tension as compared to compression. This agrees with the results obtained on BeCu alloys and reported by Woodard and Ebert in U.S. Pat. No. 4,579,603. There, they presented evidence which indicated that the rate of formation of these G.P. zones and or precipitates is different, when they are formed under compressive residual stresses, from the rate at which they are formed under tensile residual stresses.

The new model for the aging of Al-Cu alloys as proposed by Gerold and Bubeck suggests a coarsening of the Cu-rich platelets so that the thick zones are essentially all copper atoms. Cohen reports that this model would lead to the expectation of similar coarsening of the G.P. zones in a Cu-10.9 atomic percent Be alloy during the aging sequence. He describes test results in which the G.P. zones have been found to consist of from one to eight layers containing Be and Cu atoms. In each layer, the percentage of alloying Be atoms varies from 84.6% to 98.1%. It is interesting to note that he lists other shapes that contain 100% Be atoms. Then one can deduce that the hardening mechanisms for the Al-Cu alloys and the Cu-Be alloys are similar.

In U.S. Pat. No. 4,579,603, Woodard and Ebert recognize the existence of precipitate patterns that are created during the post hot forming, cold forming and precipitation hardening operations by differences in the rates of their formation. If there is a precipitate pattern, then when the precipitates are given the normal short time anneal, there Will be left a residual pattern of reduced residual stresses as well as concentrates of beryllium atoms and undissolved precipitates. This residual pattern could form the basis for the memory, which becomes evident on aging, that the formed part has of its thermal and mechanical history.

U.S. Pat. No. 4,579,603 shows that the effects of this memory can be minimized by the formation of an opposite pattern created by the second reduction and annealing taught therein. Rotem, Guha as well as U.S. patent application Ser. No. 07/164,481 (Woodard and Ebert) use high temperature anneals which have the effect of reducing the residual stress patterns and precipitate particle sizes which contribute to the effects of this memory.

Narasimhan describes a continuous casting technique, for producing amorphous metal strip which does not involve a hot rolling step. When used with the proper heat transfer media, this technique, following one or more cold rolling steps, can give narrow BeCu alloy strip which has a minimum of precipitate patterns. The production costs for producing such strip would be appreciably less than for narrow strip produced by present commercially employed techniques.

It has been found by Britton and others that a decrease in the magnitude of the existing residual stresses, that we now know are created by immersing the specimen in a salt medium, results in a decrease in the magnitude of the shrinkage that occurs on aging. Smith has shown that immersing cold worked beryllium copper strip in a hot salt medium, while it is under tension increased its elongation. Fox has shown that in beryllium copper, stress relaxation and precipitation hardening can occur simultaneously at the same temperature. The Goldstein and the McClelland patents comprehend the importance of relieving residual stresses prior to the forming operation by the incorporation of a pre-aging technique. Based on the teaching of Fox, it can be understood that in thermal treatments, such as the Goldstein and McClelland pre-aging techniques, the two reactions occur simultaneously.

Thermal treatments such as pre-aging reduce the magnitude of the existing cold working and residual stress patterns that effect the precipitation hardening. On the other hand, these thermal treatments also promote the nucleation and growth of the precipitates formed during precipitation hardening.

However, all of the prior art methods yield inconsistent non-reproducible results. The prior art methods fail to realize that there are macro residual stresses created by the types of cold worked reductions and micro residual stresses, similar to the kinds present in composites, that are created by metal flow around inert and non-coherent particles such as the cobalt beryllides.

In U.S. Pat. No. 4,579,603 issued to Woodard and Ebert, the effects of differences in heating rates on the elongation and proportional limits created in BeCu wire were described. This wire had been given a severe reduction, annealed, given a slight reduction and then had been given further cold working before being subjected to heat treatment in two different media. In one case, segments of wire were up-quenched into a molten salt bath and held for different lengths of time before being down-quenched in oil to ambient temperature. In the other case, segments of wire were inserted into an inert gaseous medium, held at temperature for the same lengths of time before being down-quenched in oil. The resultant differences in the elongation and proportional limits created by these two techniques are shown in FIGS. (1) and (2).

These beryllium copper alloys are used in those applications which need their unusual spring characteristics as well as in electrical connectors where reproducible dimensional, mechanical and electrical properties in the finished product are important if zero defects are to be obtained by the end user. These, improvements are urgently needed in the industry.

SUMMARY OF THE INVENTION

With the foregoing in mind it is a principal object of this invention to provide a process for relieving the magnitude of residual stresses in copper beryllium alloys before the formation of precipitates becomes the dominant mechanism.

A further object of this invention is to provide a process for the virtual elimination of the non-reproducible distortion which is currently experienced during the production of formed parts from copper beryllium alloys.

Yet another object of this invention is to provide a process for ensuring a relatively even distribution of precipitates throughout the alloy.

Still another object of this invention is to provide a process which will result in a copper beryllium alloy which exhibits an increased proportional limit in tandem with an increased elongation.

Another object of the invention is to provide a process for production of reproducible heat treated parts with improved mechanical properties.

A further object of this invention is to provide a more economical method for producing narrow beryllium copper alloy strip and rectangular wire.

These and other objects of the present invention may be achieved by a process comprising the steps of preparing a copper beryllium alloy melt, casting the alloy melt by a continuous process or as an alternative hot working a cast alloy and solution annealing the hot worked alloy, passing the alloy through one or more cold-working steps, applying mechanical and thermal treatments to decrease the residual lattice strains created by cold working the alloy, and then subjecting the alloy to a heat treatment, at a temperature ranging between 150° F. and 800° F., in a heat treating media that gives a rate of heat flow from the interface into the alloy that is fast enough to create those ($\alpha$) precipitation mechanism rates that result in increases in elongations and decreases in proportional limits, before appreciable precipitation hardening takes place.

The present invention is founded on the discovery that an appreciation and control of the competing mechanisms of precipitation is critical in the development of reproducible softening and hardening techniques and the effects thereof on the formation of reproducible formed parts.

That is, all thermal treatments must utilize those combinations of times, temperatures and rates of heat flow across the media-metal interface and through the specific alloy that relieve or decrease the magnitude of residual stresses before the formation of precipitates become the dominant mechanism. This is illustrated in FIG. 4 and is discussed further hereinafter.

Consequently, the alloys obtained according to the producing process of the present invention can become those primary products and parts which have improved tensile strength, formability and fatigue strength and at the same time have high conductivity and strength.

From these primary products, formed parts can be age hardened in a reproducible manner in those heat transfer media which create minimal distortion and improved mechanical properties over a broad range of temperatures. That is, those treatments, which produce the ($\alpha$) mechanism rates, optionally followed by those treatments which produce the ($\beta$) mechanism rates (defined below). can be used to treat the formed part. The process also provides for a more even patterned distribution of precipitates in the matrix of the alloy, both prior to and after a thermal aging process. The implementation of this process results in an alloy which exhibits an increased elongation in tandem with an increased yield stress.

These and other objects, features and advantages of the present invention will be appreciated upon reading of the following description of the invention when taken in conjunction with the attached drawings, with the understanding that some modifications, variations and changes of the same could be made by the skilled person in the art to which the invention pertains without departing from the spirit of the invention or the scope of claims appended hereto.

DETAILED DESCRIPTION OF THE INVENTION

Figure 1:
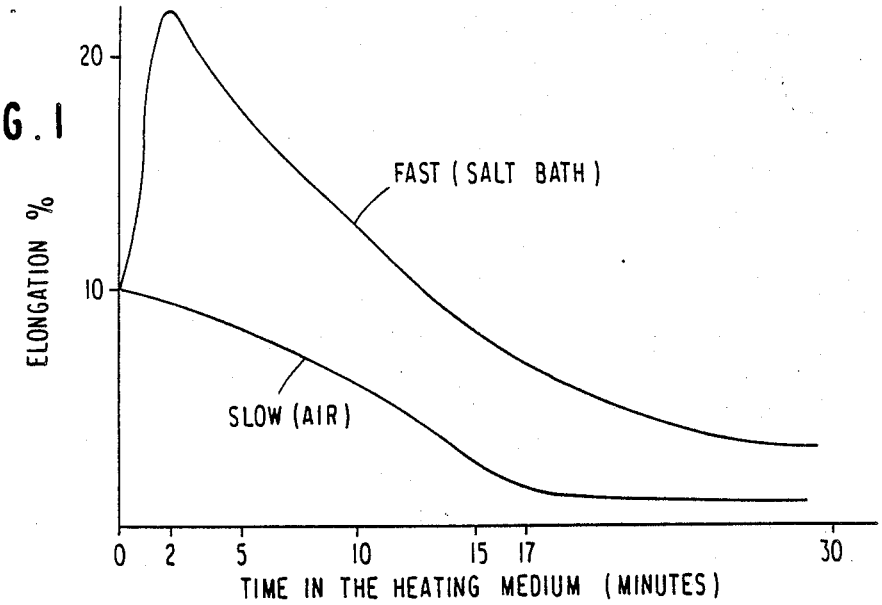
FIG. 1 depicts the measured changes with time in elongation as the wire was heat treated in the salt and air media and quenched.
Figure 2:
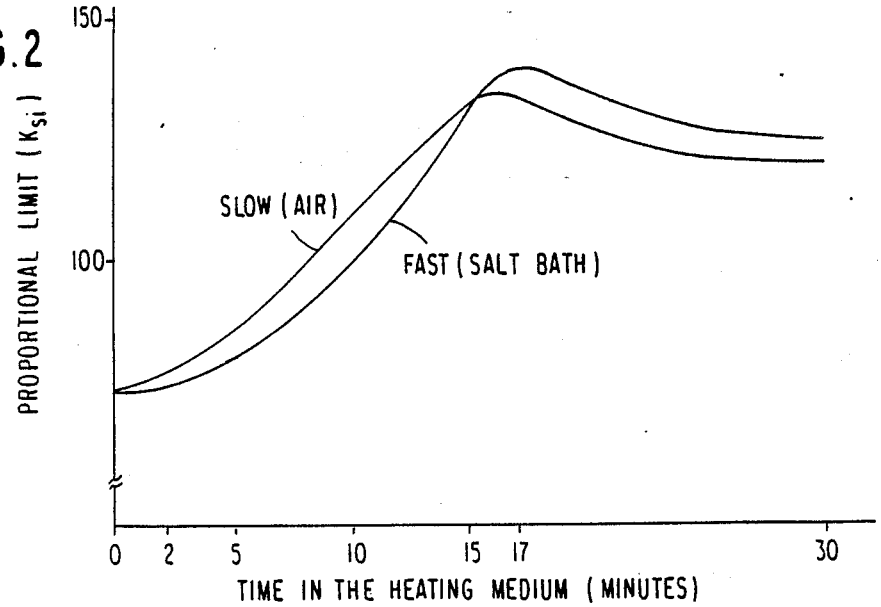
FIG. 2 depicts as above with "proportional limit".
Figure 3B:
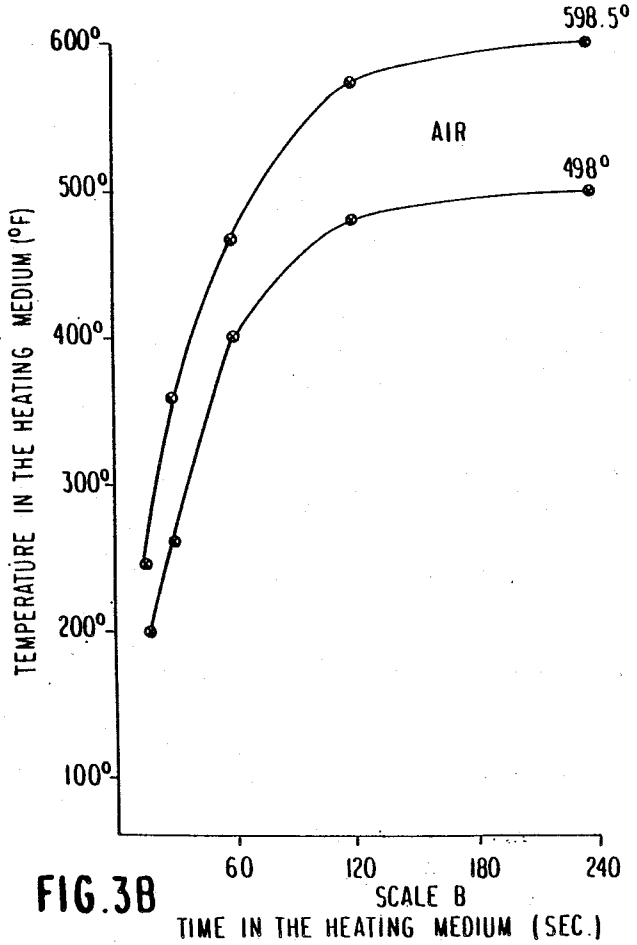
FIG. 3 is a plot of the average metal temperature against time for three media, the curves being obtained from a computer model.
Figure 3A:
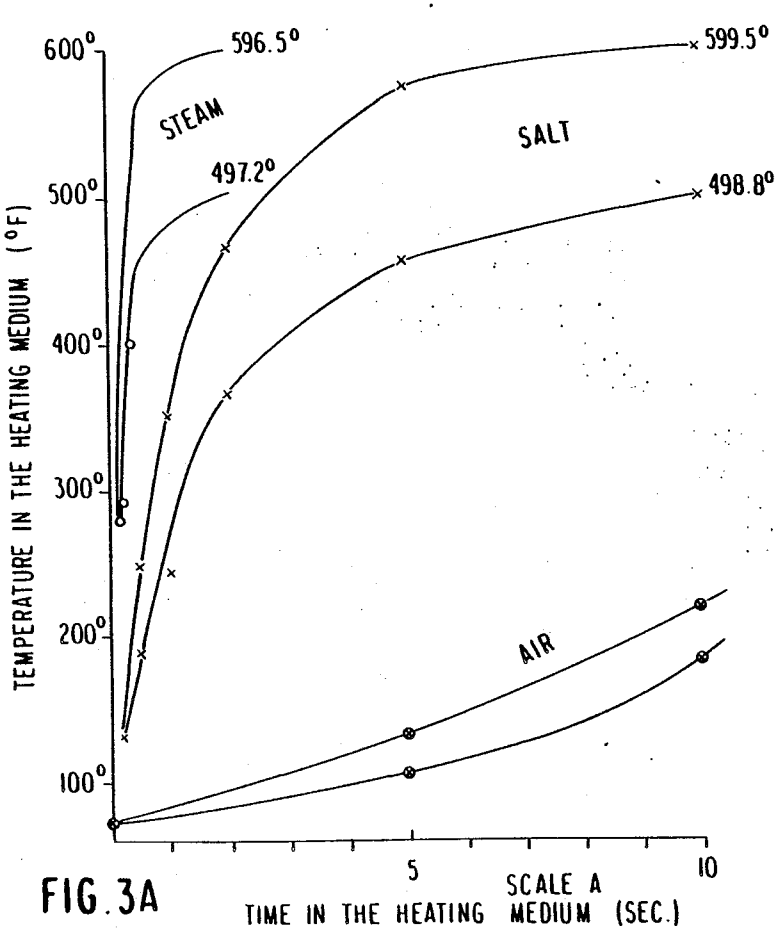
Figure 4:
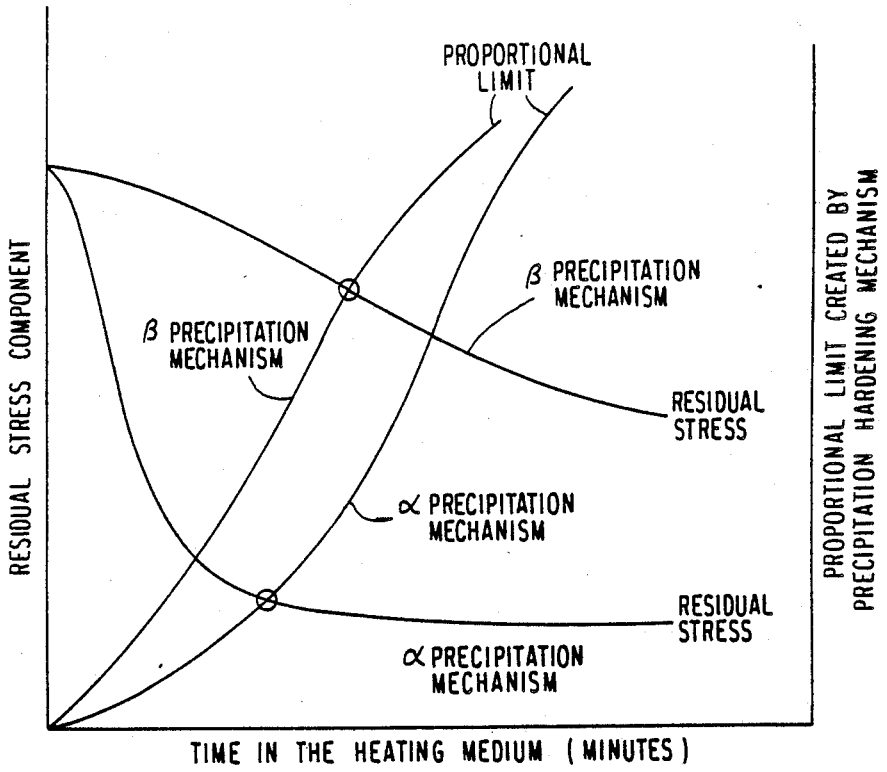
FIG. 4 is a plot of the behavior with time of the Proportional Limit and the Residual Stress Components for ($\alpha$) and ($\beta$) precipitation mechanisms.
Figure 5:
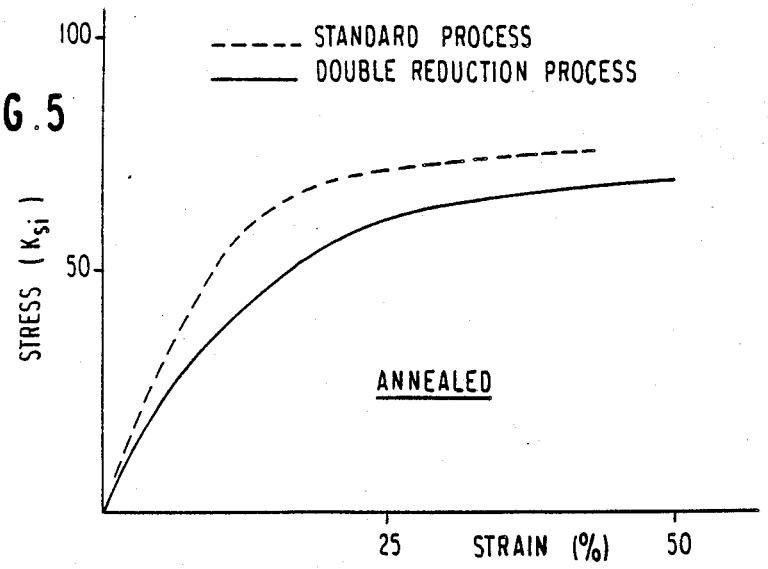
FIG. 5 is a plot of stress versus strain for annealed strip that had been given (a) the standard process treatment and (b) the double reduction treatment as defined in the specification.
Figure 6:
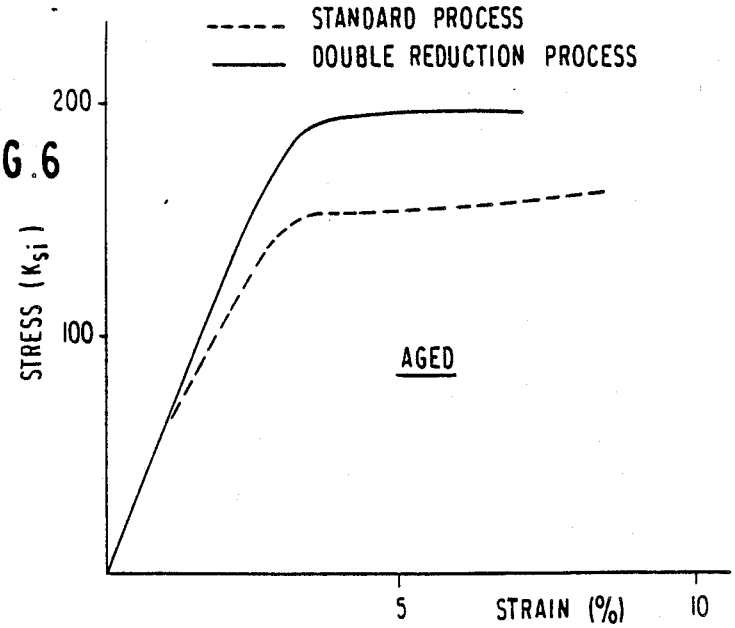
FIG. 6 is a plot of stress versus strain for aged strip that had been given (a) the standard process treatment and (b) the double reduction treatment as defined in the specifications.

The alloy according to the present invention may be produced by an ordinary atmospheric melting, and may be cast by using an arbitrary casting system. A cast ingot is subjected to hot forging and hot rolling to obtain an intermediate material, which is repeatedly subjected to cold rolling and annealing or as an alternative, thin, narrow strip may be formed by continuous casting techniques, cold worked and subjected, in the media taught in this invention, to fast heat-ups in the 400° F. to 1300° F. range. Then, the resulting cold rolled sheet undergoes solution treatment at from 1550° to 1850° C. and cold processing from 0 to 80%, followed by aging treatment. Ordinarily, the aging treatment is preferred to be performed at from 380° to 530° F.

Turning to the results plotted in FIGS. (1) and (2). the most interesting observation is that by two minutes after being inserted into the particular heating medium, the segments seem to know whether they are going to show high elongation and low proportional limit or low elongation and high proportional limit. Since both the elongation and the proportional limit are determined by the mechanism of precipitation, we can conclude that there are effective differences in the mechanisms of precipitation that are involved in these two cases.

It is well recognized that the initial mechanisms of precipitation involve stress relieving, diffusion of Be atoms and vacancies, clustering and the formation of G.P. zones, though not necessarily in that order.

For the purposes of this patent, we shall define as the ($\alpha$) precipitation mechanism those heat treatment temperatures and media which cause in the alloy those combinations of rates of stress relieving, diffusing of Be atoms and vacancies, clustering and the forming of G.P. zones that result in increases in elongation and decreases in proportional limits. On the other hand, we shall define as the ($\beta$) precipitation mechanisms those temperatures and media which cause those rate combinations of the same qualities which result in decreases in elongation and increases in proportional limits. While these mechanisms prevail under any and all conditions, their specific rates may vary depending upon their macro and micro residual stress patterns, the shape and distribution of their non-coherent particles, as well as their rates of heat-up.

Since the salt and hot air media have different rates of heat transfer across the medium-metal interface let us look at the heat flow in the metal for these two cases. To do this, a computer model was set up to calculate the heating profile for a strip of BeCu alloy based upon non-steady state combined convective/conductive heat transfer. The strip was assumed to be 10 inches $\times$ 10 $\times$ 0.026 inches and at an initial temperature of 70° F. Three heating media were studied. The were (1) Air with a Convective Heat Transfer Coefficient of 5 BTU/hr-ft$^2$-°F.; (2) Salt with a Convective Heat Transfer Coefficient of 122 BTU/hr-ft$^2$-°F.; and. (3) Steam with a Convective Heat Transfer Coefficient of 1000 BTU/hr-ft$^2$-°F.

The calculations showed that, as one went from air to salt to saturated steam, the rate of heat flow across the media-metal interface and the rate of heat flow through the metal increased. The center of the strip reached the final temperature of 600° F. in the salt medium in 15.8 sec. while in air it took 375.8 sec. The following is a tabulation of the times to reach uniform temperature for the three media:

| Heating Media | Media Temp. °F. | Center of Strip Temp. °F. | Time for Center of Strip to Reach Temp. °F. |
|---|---|---|---|
| Steam | 600 | 600 | 1.86 sec. |
| | 600 | 596.5 | 1 sec. |
| Salt | 600 | 600 | 15.8 sec. |
| | 600 | 599.5 | 10 sec. |
| Air | 600 | 600 | 375.8 sec. |
| | 600 | 598.5 | 240 sec. |
| Steam | 500 | 500 | 1.86 sec. |
| | 500 | 497.2 | 1 sec. |
| Salt | 500 | 500 | 15.8 sec. |
| | 500 | 498.8 | 10 sec. |
| Air | 500 | 500 | 375.8 sec. |
| | 500 | 498.8 | 240 sec. |
| Steam | 400 | 400 | 1.86 sec. |
| | 400 | 397.8 | 1 sec. |
| Air | 400 | 400 | 375.8 sec. |
| | 400 | 399.1 | 240 sec. |

If the temperature at the center of the strip is plotted against time for the three media, the curves of FIG. (3) are obtained for this computer model.

While such a computer model can only give guidelines for real world specimens, it is evident that the rate of heat flow across the medium-metal interface is over 20 times as fast for the salt-BeCu alloy interface as for the air-BeCu alloy interface. The rate is even higher for the steam-BeCu alloy interface. Then we can expect that our BeCu wire reaches 600° F. approximately 20 times faster in the salt medium than it does in air. That would mean that the decrease in the magnitude of the residual stress component of our "salt created" ($\alpha$) precipitation mechanism is much faster than the decrease in the magnitude of the residual stress component for our "air created" ($\beta$) precipitation mechanism. This is illustrated by the Residual Stress Component curves in FIG. (4).

Also, there are those ($\alpha$) and ($\beta$) combination rates of the diffusing Be atoms and vacancies, the clustering of Be atoms and the forming of G.P. zones and gamma precipitates that create changes in the proportional limit due to their precipitation hardening mechanisms. The ($\beta$) combinations result in a much faster rate of increase of the proportional limit in air than in the salt medium when compared to the ($\alpha$) mechanisms. The precipitation hardening curves of FIG. (4) are typical of such behavior.

It is well recognized that an increase in residual stresses with an accompanying increase in proportional limit results in a decrease in elongation. Similarly, it is well recognized that a decrease in residual stresses and an accompanying decrease in proportional limit results in an increase in elongation.

Then to increase the formability or elongation of our alloy, we may use those thermal treatments which utilize those combinations of time, temperature and rate of heat flow across the medi-BeCu interface which relieve or decrease the magnitude of residual stresses before the formation of precipitates becomes the dominant mechanism. Yet, to increase the proportional limit of our alloy we may use those combinations of time, temperature and rate of heat flow across the media-BeCu interface that increase the rate of precipitation hardening without obtaining appreciable stress relief. In our claims, we shall describe those combinations of heat treatments and heating media that enable us to maximize both the formability and the proportional limit of BeCu alloys.

An example of the effects on mechanical properties of the creation of ($\alpha$) rate mechanisms of precipitation followed by the creation of ($\beta$) rate mechanisms of precipitation follows.

In U.S. application Ser. No. 07/164,481, Woodard and Ebert compared the tensile results obtained on strip prepared using standard techniques with strip given a high reduction, annealed, given a low reduction, immersed in a salt bath and cold worked. This double reduction had the effect of superimposing macro and micro compressive residual stresses on volumes having tensile residual stresses and vice versa. This mean that such strip had a reduction in the magnitude of the residual stresses before being subjected to further reductions in the salt bath. The immersion in the salt Gath meant that the part was subjected to the ($\alpha$) rate of mechanisms of precipitation.

They found that when specimens from both treatments were tested, the strip given the double reduction showed an increase in elongation over the standard strip while the average 0.01% and 0.2% offset yields decreased. Annealing both strips only increased the magnitude of this effect. On the other hand, when duplicate specimens were aged in air and thereby subjected to the ($\beta$) rate of precipitation mechanisms, the elongations of the double reduction specimens were reduced and the average 0.01% and 0.2% offset yields were appreciably increased.

Let us review the elongation curves of FIG. (1). It is evident that the difference between the effects of the ($\alpha$) precipitation mechanisms and those of the ($\beta$) precipitation mechanisms on the elongation rises, at the same time intervals, to a maximum and then decreases. The proportional limit curves of FIG. (2) show a similar behavior but on different time settings. Then it should be possible by employing the proper heat treating media to use the ($\alpha$) mechanism of precipitation for a specific length of time, switch to the ($\beta$) mechanism of precipitation for short times and/or long times of heating and thereby obtain the best combination of formability and strength for the specific alloy that had been cold formed under its specific set of conditions. Then by using a computer technique such as that described in the article entitled "Optimization by Simulated Annealing" authored by S. C. Kirkpatrick D. Gelatt and N. P. Becchi in *Science*, Vol. 220, pp. 671–680, 1983, it becomes possible to determine the best time combinations for the two media.

A consideration of the curves of FIGS. (3) and (4) shows that increasing the rate at which heat flows across the media-metal interface as we go from the air media to the molten salt media increases the rate at which the residual stresses and proportional limit are reduced and thereby increases the elongation. Then we should expect that as we go from the molten salt-BeCu interface to the steam-BeCu interface there should be an even greater increase in elongation or formability.

There are many guidelines to help us select those heat transfer media that will maximize the formability of the particular shape and alloy to be treated. The time/temperature curves of FIG. (3) are typical for results obtained from three classes of heat transfer media. They are:

Class (A) - All vapors that are not condensing - such as hot air or hot inert gases.

Class (B) - High density fluids. Typical of these are molten salts, hot oils and hot water.

Class (C) - Condensing vapors. Typical of these are pressurized steam or the commercial condensing vapor heat transfer media such as the Dowtherms.

U.S. Pat. No. 3,138,493 (Smith) teaches the use of molten salt as a heat treating media. However, there are several disadvantages to the use of molten salt. It is quite corrosive and attacks the surface of BeCu alloys. Removing this corrosion surface layer is a costly and time consuming process. Most importantly, because of its viscosity, it becomes virtually impossible to get uniform and reproducible heat flow across the surface of intricately formed parts. Further, what are termed "cold pockets" are usually found in molten salt.

None of these disadvantages are found in the use of pressurized steam or other hot condensing vapors. Yet it is evident from FIG. (3) that for all of these condensing vapor media, the rate of heat flow across such media-metal interfaces is fast enough to create increased reduction in the magnitudes of the residual stresses and proportional limits before the precipitation hardening mechanism becomes dominant. Lowering the initial residual stress increases the magnitude of this effect.

Cohen, who has proposed a new model for the coarsening of the G.P. zones, does not define the rate at which his beryllium copper alloy is aged into the so-called GP 2 state. He has found that his initial G.P. zones are ellipsoidal and aligned along the <110> directions. Phillips and Tanner, who aged their specimens in boiling ethylene glycol at approximately 198° C. found that this gave their specimens a fast rate of heating. They found a pronounced <110> tweed structure for their G.P. zones. Like Cohen, they also found in such specimens a stacking of zones on adjacent planes. Woodard and Ebert found that differences in the rates at which BeCu alloys are heated create differences in the initial mechanical properties of the beryllium copper alloys.

Since these differences in their initial mechanical properties are created by differences between the ($\alpha$) and ($\beta$) precipitation mechanisms, the inventor has proposed that pronounced differences in the structures of the G.P. zones can be found between specimens heated in air and those heated in steam. Here, the differences in the rate at which thermal energy flows into a volume would create differences in the rates of diffusion and clustering of the Be atoms and thereby create differences in the types and amounts of crystalline structure formed.

The subject invention is believed to be adaptable to a wide range of copper beryllium alloys. These alloys will generally contain from 0.2 to 3.0% beryllium, up to 3.5% of material from the group consisting of cobalt and nickel, and at least 90% copper. Other elements may be present for various purposes such as castability, machinability and grain refinement, or as incidental impurities.

Since most commercially available grades of beryllium copper alloys contain cobalt beryllides, the effects of these beryllides on this invention must be taken into account. One of the effects of cobalt beryllides on the mechanical properties of a beryllium copper alloy is that the size and distribution of these cobalt beryllide precipitates, that can be controlled during the casting process, have an appreciable effect on the rate of work hardening. Based on studies of stresses formed during the dynamic behavior of composites, it is realized that the cobalt beryllide particles are surrounded by regions of tensile and compressive strain set up by the cold working. The particle size distributions of these and other inert precipitates must have a profound effect upon the rate of decrease in the average amplitude of these microresidual strains. Therefore, cobalt beryllides must also have an effect on those combinations of time and temperature that are needed to stress relieve the alloys. Thus, it will be appreciated that in the application of this invention, times and temperatures may have to be adjusted to accommodate the particular size and distribution of cobalt beryllides in the alloy which one is processing.

To summarize, to obtain the maximum formability in the primary products and the maximum mechanical properties, as well as the minimum non-reproducible geometric distortion in a part after aging, we must have:

(1) As low an initial residual stress as possible;

(2) As uniform an initial residual stress distribution as possible;

(3) As reproducible an initial residual stress pattern as possible;

(4) As fast a heat flow across the media-metal interface as possible:

(5) As high and as uniform a heat flow rate throughout the part as possible; and (6) The proper combination of particle size distributions for the cobalt beryllides as determined by the casting and/or hot working schedules.

When subjected to a long time heat treatment in a media with a low rate of heat transfer, such specimens would then give the highest possible offset yields.

What is claimed is:

1. A process for producing primary products from GP zone and gamma precipitate containing alloys, which process comprises the steps of:

preparing a copper beryllium alloy melt;

casting the alloy melt by a continuous process or hot working a cast alloy and solution annealing the hot worked alloy:

passing the alloy through one or more cold-working steps:

applying mechanical and thermal treatments to decrease the residual lattice strains created by cold working the alloy; and then subjecting the alloy to one or more heat treatments at temperatures ranging between 150° F. and 800° F., in a condensing vapor type heat treating media that gives a rate of heat flow from the interface into the alloy that is fast enough to create those ($\alpha$) precipitation mechanism rates that result in increases in elongations and decreases in proportional limits before quenching.

2. A process as in claim comprising subjecting said beryllium copper alloy to a heat treatment, at temperatures ranging between 150° F. and 800° F., in a heat treating media that gives a rate of heat flow from the interface into the alloy that is fast enough to create those ($\alpha$) precipitation mechanism rates that result in increases in elongations and decreases in proportional limits, then subjecting the alloy to a further heat treatment in the 550°-825° F. range, in a media that creates a heat flow across the media-metal interface that is slow enough to create those ($\beta$) precipitation mechanism rates that result in decreases in elongations and increases in proportional limits.

3. A process for producing primary products as in claim 1, wherein said casting of the alloy melt is by a continuous process comprising forcing molten alloy onto the surface of a moving chill body to form a thin, continuous, amorphous strip of alloy, and wherein said process further comprises cold working by reducing said alloy at least one time, subjecting the alloy to at least one heat treatment after each cold working reduction at temperatures ranging from 400° F. to 800° F., wherein each said heat treatment is followed by a quench to below 250° F. before further cold working.

4. A process according to claim 1, wherein the heat treating media is one which has minimal corrosive attack on the surface of the beryllium copper alloy, and is applied by using a condensation heat transfer process with promoters.

5. A process according to claim 1, wherein the heat treating media is selected from the group consisting of Dowtherms A, E and G, Therminol FR-2, the Silicon Hydrotherms and heat fluidized beds.

6. A process according to claim 1, wherein said heat treating media is selected from pressurized steam and vaporized hydrocarbons.

7. A process according to claims 1, wherein the cold working is done at those slow rates which create minimal turbulence, thereby maximizing the uniformity of the thickness of the strip.

8. A process according to claim 1, wherein the alloy is annealed at 1550°-1850° F. prior to the heat treating; the alloy is then given a pair of cold working reductions, each cold working reduction followed by a solution anneal, the first reduction being in excess of 35%, the second reduction being between 5% and 15%, and wherein the resulting product, after subjecting to a heat treatment at temperatures and in a heat treating media that gives a rate of heat flow from the interface into the alloy that is fast enough to create those ($\alpha$) precipitation mechanism rates and that result in increases in elongations and decreases in proportional limits and is work hardened by further cold working.

9. A process according to claim 1, wherein the alloy is annealed at 1550°-1850° F. prior to its cold working, then cold worked and heat treated, the heat treatment being conducted at 250°-525° F. for 30 seconds to 30 minutes, and the resulting quenched product is further work hardened by cold working to put it in a mill hardened condition.

10. A process according to claim 1, wherein the alloy is in the form of a strip and is subjected to the heat treating at a temperature of 250°-525° F. for up to 30 minutes, quenched, then slit into narrower strip, and the narrower strip is then subjected to further heat treating at 325°-525° F. for up to 2 hours.

11. A process according to claim 1, wherein the primary product is a strip that is formed by cold rolling in a plurality of passes, each one with the faces being reversed from the previous cold rolling pass but with the leading end being the same.

12. A process according to claim 9, wherein the cold prior to the heat treating is done to effect at least a 91% reduction in the alloy thickness.

13. A process according to claim 10, wherein the narrower strip is put in a mill hardened condition by further cold working.

14. A process according to claim 10, wherein the alloy is machined or otherwise reproducibly formed at those rates which minimize the turbulence, into a part, and the part is subjected to heat treating in the heating media of claims 5, 6 and 7 at a temperature of 250°-525° F. for 30 seconds to 30 minutes before being heated in an inert atmosphere at a temperature of 525°-800° F. for up to 6 hours prior to quenching.

15. A process according to claim 10, wherein the heat treating of a narrower strip is done at 600°-775° F. for 30 seconds to 4 hours prior to quenching.

16. A process according to claim 14, wherein the heat treating is done at 600°-700° F. for 2-20 minutes prior to quenching.

17. A process according to claim 14, wherein the heat treating is done in a heat treating media whose heat flow rate across the metal-media interface approximates the heat flow rate in the cold worked beryllium copper alloy, at 325°-800° F. for 2-20 minutes, then further precipitation hardened in an inert atmosphere.

18. A process according to claim 14, wherein the alloy is further heat treated at a temperature of 550°-800° F. in a media with a low rate of heat transfer for ½ to 4 hours.

19. A process according to claim 18, wherein the heat treating is done without appreciably lowering the specimen temperature.

20. A process for producing parts from GP zone and gamma precipitate containing alloys, which process comprises the steps of:

preparing a copper beryllium alloy melt or an aluminum copper alloy melt;

casting the alloy melt by a continuous process or hot working the cast alloy and solution annealing the hot worked alloy:

passing the alloy through one or more cold-working steps;

applying mechanical and thermal treatments to decrease the residual lattice strains created by cold working the alloy;

subjecting the alloy to a heat treatment, at temperatures ranging between 150° F. and 800° F., in a condensing vapor type heat treating media that gives a rate of heat flow from the interface into the alloy that is fast enough to create those ($\alpha$) precipitation mechanism rates that result in increases in elongations and decreases in proportional limits, thereafter attaining and maintaining the heat treating temperature before appreciable precipitation hardening takes place before quenching:

forming a part from the alloy, and subjecting the part to a heat treatment, at temperatures ranging between 150° F. and 800° F., in a heat treating media that gives a rate of heat flow from the interface into the part that is fast enough to create those ($\alpha$) precipitation mechanism rates that result in increases in elongations and decreases in proportional limits, thereafter attaining and maintaining the heat treating temperature before appreciable precipitation hardening takes place before quenching or subjecting the part to further heat treatment.

21. A process as in claim 20, wherein said part is further subjected to those ($\beta$) precipitation mechanism rates that result in decreases in elongation and increases in proportional limits.

22. A process for producing parts from G.P. Zone and gamma precipitate containing alloys, which process comprises the steps of:

preparing a copper beryllium alloy melt or an aluminum copper alloy melt;

casting the alloy melt by a continuous rapid solidification process or hot working the cast alloy and solution annealing the hot worked alloy;

applying mechanical and thermal steps to decrease the lattice strains created by the rapid solidification process;

passing the alloy through one or more cold-working steps;

applying mechanical and thermal treatments to decrease the residual lattice strains created by cold working the alloy;

subjecting the alloy to a heat treatment, at temperatures ranging between 150° F. and 800° F., in a condensing vapor type heat treating media that gives a rate of heat flow from the interface into the alloy that is fast enough to create those ($\alpha$) precipitation mechanism rates that result in increases in a elongations and decreases in proportional limits, thereafter attaining and maintaining the heat treating temperature before appreciable precipitation hardening takes place before quenching;

quenching;

forming a part from the alloy;

machining a depression or groove into at least one face of said part;

removing residual stresses by subjecting the alloy to a heat treatment, at temperatures ranging between 150° F. and 800° F., in a condensing vapor type heat treating media that gives a rate of heat flow from the interface into the alloy that is fast enough to create those ($\alpha$) precipitation mechanism rates that result in increases in elongations and decreases in proportional limits, thereafter attaining and maintaining the heat treating temperature before appreciable precipitation hardening takes place before quenching;

quenching;

providing at least one metal or alloy in said depression and mechanically bonding said metal or alloy to said part by warm or cold rolling and removing residual stresses by subjecting the alloy to a heat treatment, at temperatures ranging between 150 ° F. and 800° F., in a condensing vapor type heat treating media that gives a rate of heat flow from the interface into the alloy that is fast enough to create those ($\alpha$) precipitation mechanism rates that result in increases in elongations and decreases in proportional limits, thereafter attaining and maintaining the heat treating temperature before appreciable precipitation hardening takes place before quenching;

quenching; and subjecting the part to a heat treatment, at temperatures ranging between 150 ° F. and 800 ° F., in the heat treating media that gives a rate of heat flow from the interface into the part that is fast enough to create those ($\alpha$) precipitation mechanism rates that result in increase in elongations and decreases in proportional limits before appreciable precipitation hardening takes place, thereafter attaining and maintaining the heat treating temperature before quenching and subjecting the part to further heat treatment, and further subjecting the part to a heat treatment at a temperature of 550°-800° F. in a media with a low rate of heat transfer for ½ to 4 hours.

23. A process as in claim 22, wherein said part has parallel top and bottom surfaces and two side surfaces, wherein at least one of said surfaces has a groove machined into it, the groove having sides parallel to the sides and one face parallel to the bottom surface.

24. A process as in claim 22, wherein said metal or alloy deposited in said groove or depression is gold.

* * * * *